US007901249B1

(12) United States Patent
Chen

(10) Patent No.: US 7,901,249 B1
(45) Date of Patent: Mar. 8, 2011

(54) POWER CONNECTOR

(76) Inventor: Wan-Tien Chen, Taipei (TW)

( * ) Notice: Subject to any disclaimer, the term of this patent is extended or adjusted under 35 U.S.C. 154(b) by 0 days.

(21) Appl. No.: 12/765,074

(22) Filed: Apr. 22, 2010

(51) Int. Cl.
*H01R 13/648* (2006.01)

(52) U.S. Cl. ..... 439/607.4

(58) Field of Classification Search .. 439/607.35–607.4, 439/63, 581, 675
See application file for complete search history.

(56) References Cited

U.S. PATENT DOCUMENTS 5,927,999 A * 7/1999 Shimojyo ..... 439/63
7,101,189 B1 * 9/2006 Huss et al. ..... 439/63
7,510,437 B2 * 3/2009 Wu ..... 439/581
7,540,772 B2 * 6/2009 Sardi et al. ..... 439/581
7,621,753 B1 * 11/2009 Pai ..... 439/63

* cited by examiner

*Primary Examiner* — Phuong K Dinh
(74) *Attorney, Agent, or Firm* — Guice Patents PLLC

(57) ABSTRACT

The present invention relates to a power connector, capable of receiving a plug, comprises: a body; a shield housing; a front cover; a positive column; a first grounding terminal capable of providing a buffering effect when the plug is inserted; and a second grounding terminal which is in contact with a sleeve when the plug is inserted so as to provide a buffering effect. Moreover, the first grounding terminal and the second grounding terminal are respectively installed with a reverse stab so as to be fastened on the body for preventing from being released from the body.

18 Claims, 7 Drawing Sheets

A-A

B-B

POWER CONNECTOR

BACKGROUND OF THE INVENTION

1. Field of the Invention

The present invention relates to a power connector, especially to a power connector in which resilient sheets and reverse stabs are installed, wherein the resilient sheets are served to provide a buffering effect and the reverse stabs are served to be fastened on a body for preventing being released from the body.

2. Description of Related Art

A conventional power connector is often installed with a positive column and a grounding terminal for providing an electrical connection with a plug (not shown).

The structure of grounding terminal of a conventional power connector, e.g. "Power identification structure of connector" disclosed by the Taiwan Utility Model No. M370865; for avoiding mixing up codes of elements shown in drawings disclosed by the aforesaid patent with codes of elements which will be illustrated in this patent application, each code of the aforesaid patent is added with "'" for discrimination; as shown in FIG. 1, a first terminal 120' has six contact portions 1220', and each contact portion 1220' is in a claw-like shape so material used for forming the contact portion 1220' is a lot, and the first terminal 120' is not installed with any reverse stab structure therefore is not able to be effectively being fastened on a body 1140'.

The Taiwan Utility Model No. M372020 has disclosed a connector having fastening structure; for avoiding mixing up codes of elements shown in drawings disclosed by the aforesaid patent with codes of elements which will be illustrated in this patent application, each code of the aforesaid patent is added with "'" for discrimination; as shown in FIG. 2, a terminal 110" is installed with only two contact portions 1110", material used for forming the terminal 110" is less but the terminal 110" is not installed with any reverse stab structure therefore is not able to be effectively fastened on a body.

In view of the disadvantages of conventional power connectors, the present invention provides a novel power connector for improving said disadvantages.

SUMMARY OF THE INVENTION

One primary object of the present invention is to provide a power connector in which a resilient sheet is inwardly installed on a grounding terminal for providing a buffering effect.

Another object of the present invention is to provide a power connector in which a reverse stab is installed on a grounding terminal so as to be fastened on a body for preventing from being released from a body.

Still another object of the present invention is to provide a power connector which can reduce material used for forming a terminal and enhance the terminal strength.

For achieving the objects mentioned above, the present invention provides a power connector, capable of receiving a plug having an electric conduction terminal, a sleeve and a terminal seat, comprises: a body having a through hole, two sides of the through hole are respectively installed with a guiding slot, two sides of the body are respectively installed with a protrusion; a shield housing, which is hollow and is engaged with the body; a front cover engaged with the shield housing, the front end thereof has an orifice, two sides thereof are respectively installed with a cover hole for accommodating the protrusions and allowing the protrusions to be exposed; a positive column, one end thereof is received in the through hole, the other end thereof has a wire hole and is exposed outside the body; a first grounding terminal inserted in one of the guiding slots, one end thereof has a first terminal hole installed with an inward-retracted first resilient sheet, the other end thereof is bended so as to form a first welding sheet, when the plug is inserted, the first resilient sheet is in contact with the sleeve for providing a buffering effect; and a second grounding terminal inserted in the other guiding slot, one end thereof has a second terminal hole installed with an inward-retracted second resilient sheet, when the plug is inserted, the second resilient sheet is in contact with the sleeve for providing a buffering effect, the other end thereof is outwardly extended with a second welding sheet.

For achieving the objects mentioned above, the present invention provides a power connector, capable of receiving a plug having an electric conduction terminal, a sleeve and a terminal seat, comprises: a body having a through hole, two sides of the through hole are respectively installed with a guiding slot, two sides of the body are respectively installed with a protrusion; a shield housing, which is hollow and is engaged with the body; a front cover engaged with the shield housing, the front end thereof has an orifice, two sides thereof are respectively installed with a cover hole for accommodating the protrusions and allowing the protrusions to be exposed; a positive column, one end thereof is received in the through hole, the other end thereof is exposed outside the body and is downwardly bended to form a welding portion; a first grounding terminal inserted in one of the guiding slots, one end thereof has a first terminal hole installed with an inward-retracted first resilient sheet, the other end thereof is downwardly extended with a first welding sheet, when the plug is inserted, the first resilient sheet is in contact with the sleeve for providing a buffering effect; and a second grounding terminal inserted in the other guiding slot, one end thereof has a second terminal hole installed with an inward-retracted second resilient sheet, when the plug is inserted, the second resilient sheet is in contact with the sleeve for providing a buffering effect, the other end thereof is outwardly extended then downwardly bended to form a second welding sheet.

DETAILED DESCRIPTION OF THE PREFERRED EMBODIMENT

Figure 1:
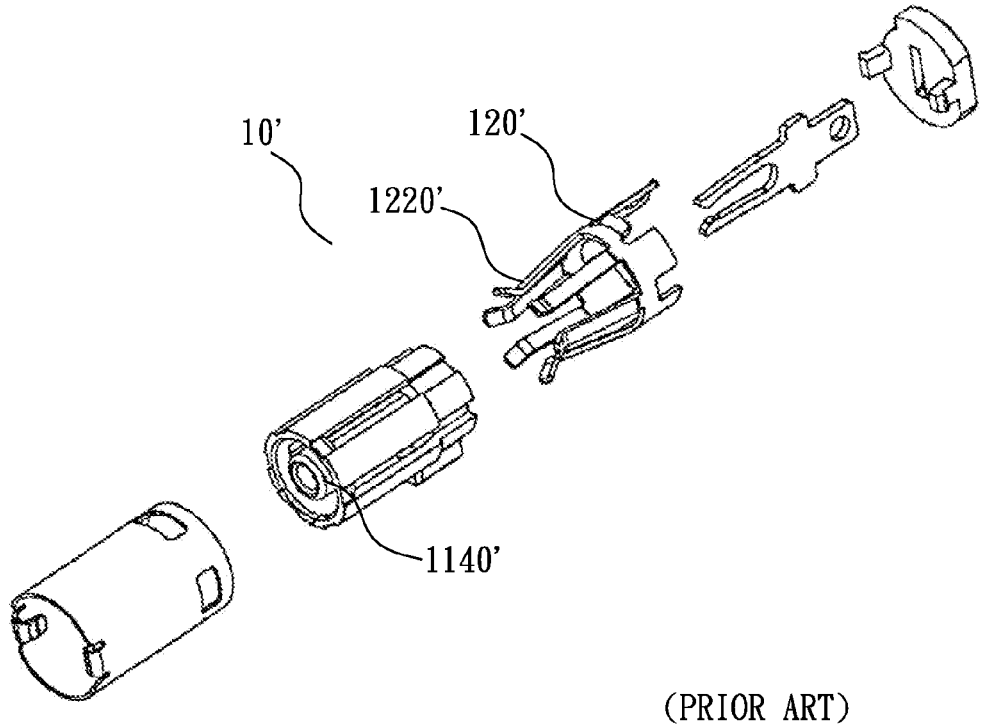
(PRIOR ART) FIG. 1
FIG. 1 is a schematic exploded view of a conventional power connector.
Figure 2:
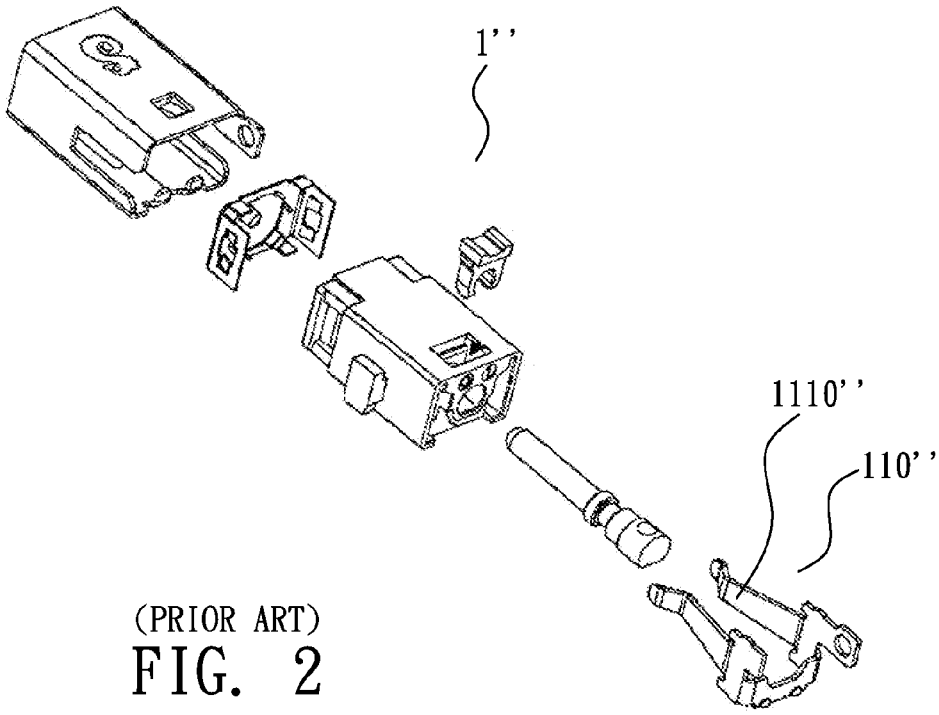
(PRIOR ART) FIG. 2
FIG. 2 is a schematic exploded view of another conventional power connector.
Figure 3:
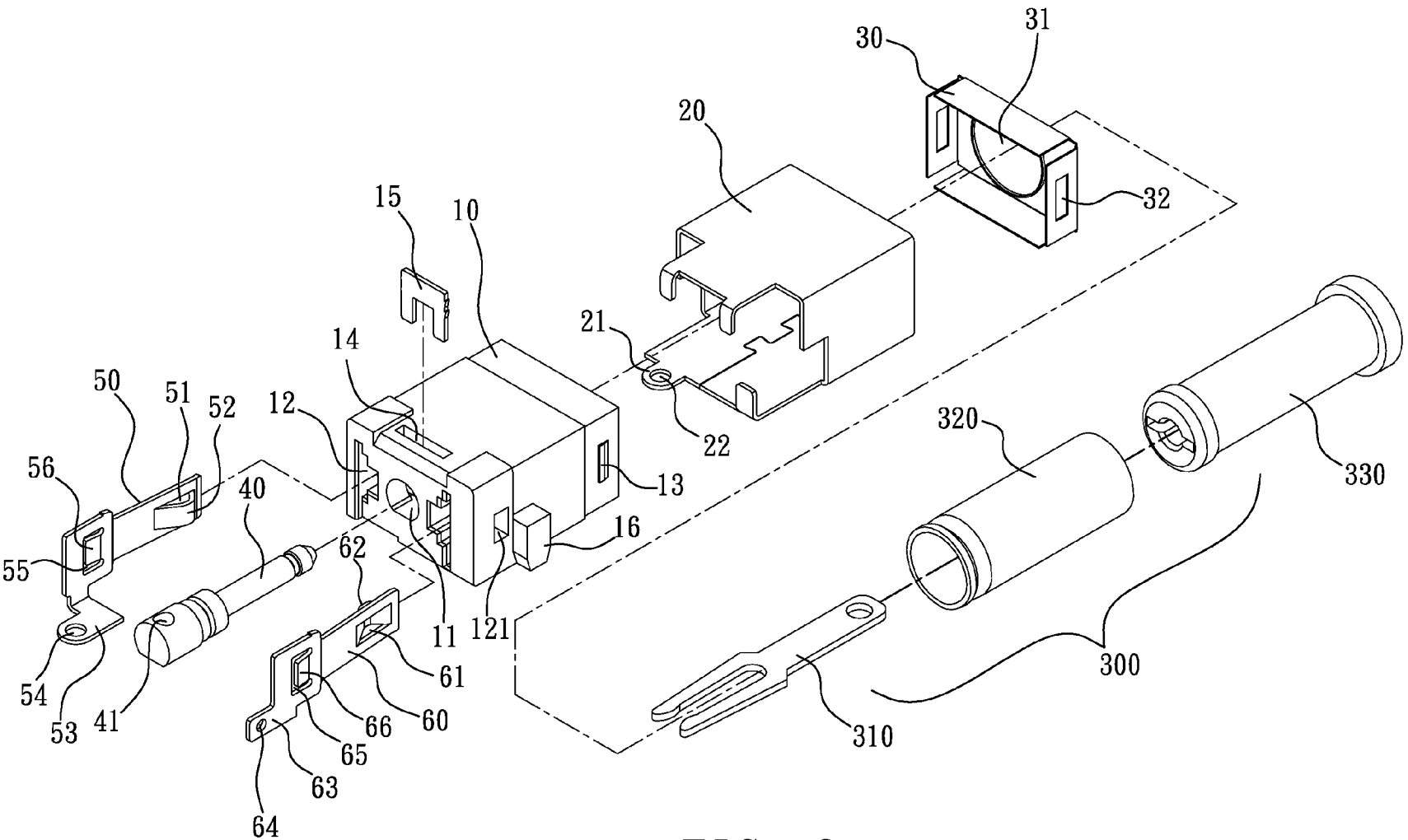
FIG. 3 is a schematic exploded view of the power connector of one preferred embodiment of the present invention.
Figure 4:
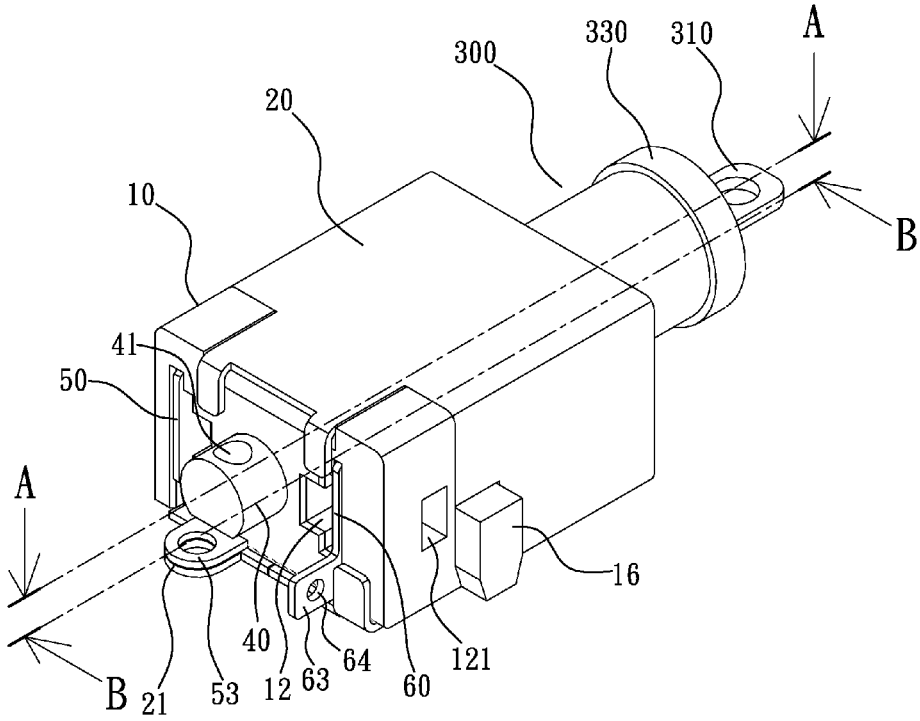
FIG. 4 is a schematic assembly view of the power connector of one preferred embodiment of the present invention.
Figure 5A:
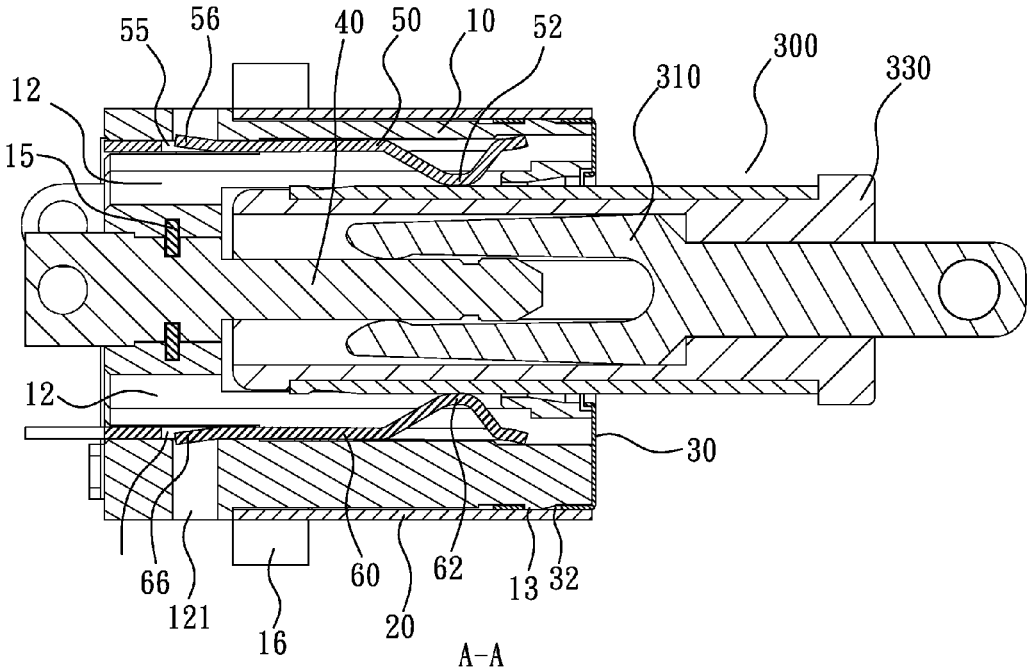
FIG. 5*a* is a schematic cross sectional view of A-A end of the power connector of one preferred embodiment of the present invention.
Figure 5B:
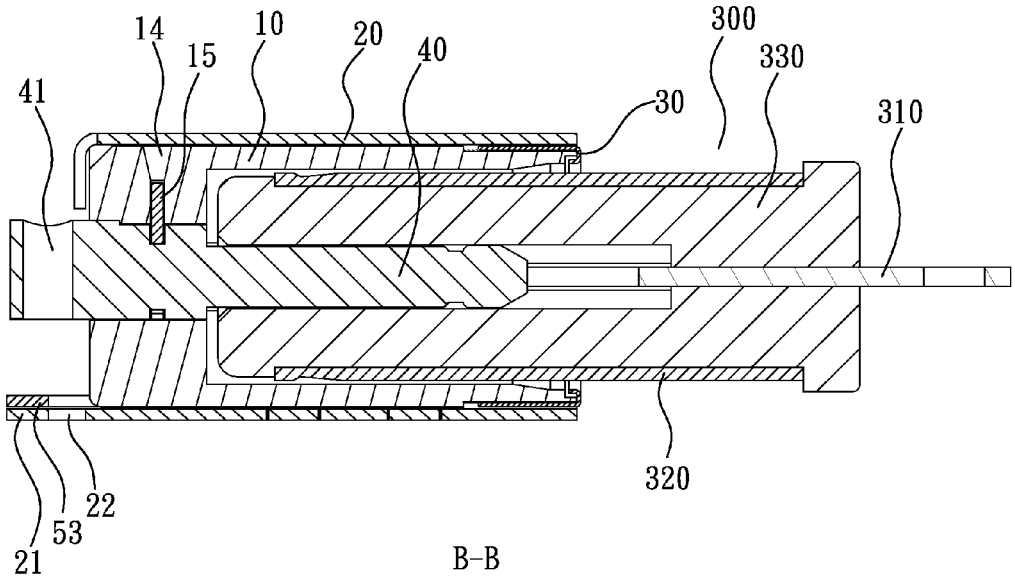
FIG. 5*b* is a schematic cross sectional view of B-B end of the power connector of one preferred embodiment of the present invention.

Referring from FIG. 3 to FIG. 5*b*, wherein FIG. 3 is a schematic exploded view of the power connector of one preferred embodiment of the present invention; FIG. 4 is a schematic assembly view of the power connector of one preferred embodiment of the present invention; FIG. 5*a* is a schematic cross sectional view of A-A end of the power connector of one preferred embodiment of the present invention; FIG. 5*b* is a schematic cross sectional view of B-B end of the power connector of one preferred embodiment of the present invention.

As shown in figures, the power connector provided by the present invention is capable of receiving a plug 300; the plug 300 includes an electric conduction terminal 310, a sleeve 320 and a terminal seat 330; wherein the electric conduction terminal 310, the sleeve 320 and the terminal seat 330 are conventional arts and are not the primary features of the present invention, therefore no further illustration is provided. The power connector provided by the present invention comprises: a body 10; a shield housing 20; a front cover 30; a positive column 40; a first grounding terminal 50; and a second grounding terminal 60.

The body 10 is made of, e.g. but not limited to, plastic material, and is installed with a through hole 11, two sides of the through hole 11 are respectively installed with a guiding slot 12, two sides of the body 10 are respectively installed with a protrusion 13. The top end of the body 10 is further provided with a fastening slot 14 disposed on top of the through hole 11.

The shield housing 20 is made of metal material, e.g. but not limited to stainless steel, and the shield housing 20 is hollow and able to be engaged with the body 10.

The front cover 30 is made of metal material, e.g. but not limited to stainless steel, the front cover 30 is able to be engaged with the shield housing 20 and the front end thereof has an orifice 31, the sides thereof are respectively installed with a cover hole 32 for accommodating the protrusions 13 and allowing the protrusions 13 to be exposed.

One end of the positive column 40 is accommodated in the through hole 11, the other end thereof has a wire hole 41 and exposed outside the body 10, the wire hole 41 is provided for installing a conduction wire (not shown).

The first grounding terminal 50 is accommodated in the guiding slot 12, one end thereof has a first terminal hole 51 installed with an inward-retracted first resilient sheet 52, the other end thereof is inwardly bended to substantially 90 degree then is formed with a first welding sheet 53 installed with a welding hole 54 for being welded on a substrate (not shown). As shown in FIG. 5*a*, when the plug 300 is inserted in the body 10, firstly the electric conduction terminal 310 is in contact with the positive column 40, the first resilient sheet 52 is not only served to be in contact with the sleeve 320 for providing a grounding function, but also served to provide a buffering effect of applying longitudinal force on top of the sleeve 320. Moreover, the other end of the first grounding terminal 50 is further installed with a third terminal hole 55 having an inward-retracted reverse stab 56.

The second grounding terminal 60 is accommodated in another guiding slot 12, and one end thereof has a second terminal hole 61 installed with an inward-retracted second resilient sheet 62, the other end thereof is outwardly extended with a second welding sheet 63 having a welding hole 64, the second resilient sheet 62 is not only served to be in contact with the sleeve 320 for providing a grounding function, but also served to provide a buffering effect of applying longitudinal force below the sleeve 320. Moreover, the other end of the second grounding terminal 60 is further installed with a fourth terminal hole 65 having an inward-retracted reverse stab 66.

The body 10 of the present invention is further installed with a fastening sheet 15 capable of being received in the fastening slot 14 for fastening the positive column 40. The fastening sheet 15 is in, e.g. but not limited to, reversed-U shape and is made of metal material, e.g. but not limited to stainless steel. Two sides of the body 10 are respectively and protrudingly installed with a flange 16.

The guiding slots 12 installed on the two sides of the body 10 are further respectively provided with an opening slot 121 for respectively receiving the first reserve stab 56 and the second reserve stab 66.

A distal end of the shield housing 20 is further installed with a third welding sheet 21 having a third welding hole 22; the third welding hole 22 is aligned with the first welding hole 54 for being welded on the substrate.

As shown in FIG. 4, FIG. 5*a* and FIG. 5*b*, when the power connector of the present invention is being used with the plug 300, the plug 300 is inserted in the orifice 31 of the front cover 30 and is continuously being forwardly inserted till two sides of the electric conduction terminal 310 clamp the positive column 40, such that the front end of the sleeve 320 of the plug 300 is respectively in contact with the front end of the first resilient sheet 52 and the front end of the second resilient sheet 62 so as to be respectively upwardly and downwardly pressed for providing the grounding function, meanwhile the first reverse stab 56 and the second reverse stab 66 are respectively entered the opening slots 121 installed at the two sides of the body 10 for preventing the first grounding terminal 50 and the second grounding terminal 60 from being released from the body 10, so the connection of the power connector of the present invention and the plug 300 is completed. The power connector of the present invention, compared with conventional power connectors, has following advantages: 1. a resilient sheet is inwardly installed on a grounding terminal for providing buffering function; 2. the grounding terminal is installed with a reverse stab so as to be fastened on the body for preventing from being released from the body; and 3. required material for forming the terminal is reduced and the structure thereof is enhanced. Therefore the power connector of the present invention is novel compared with the conventional power connectors.

Figure 6:
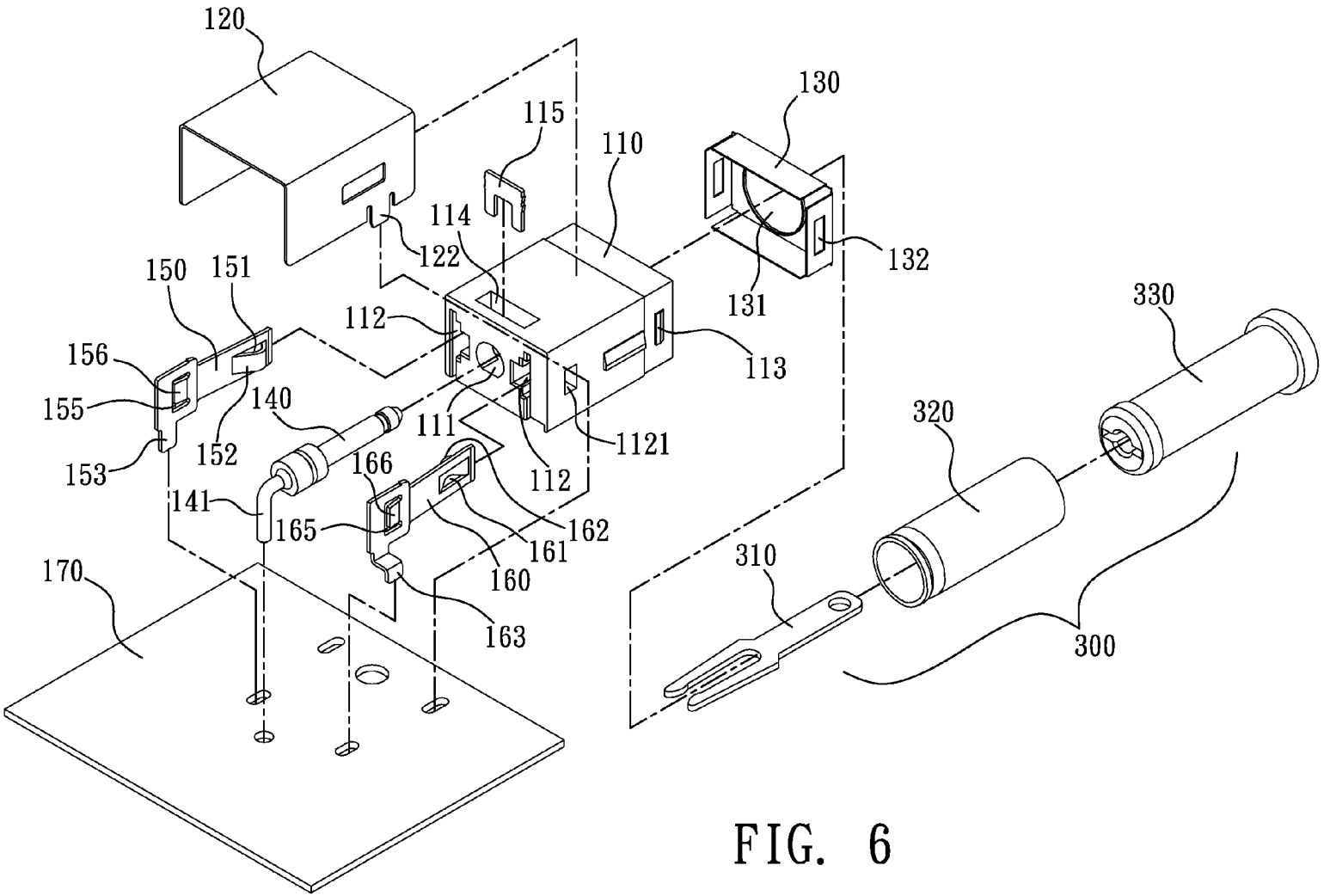
FIG. 6 is a schematic exploded view of the power connector of another preferred embodiment of the present invention.
Figure 7:
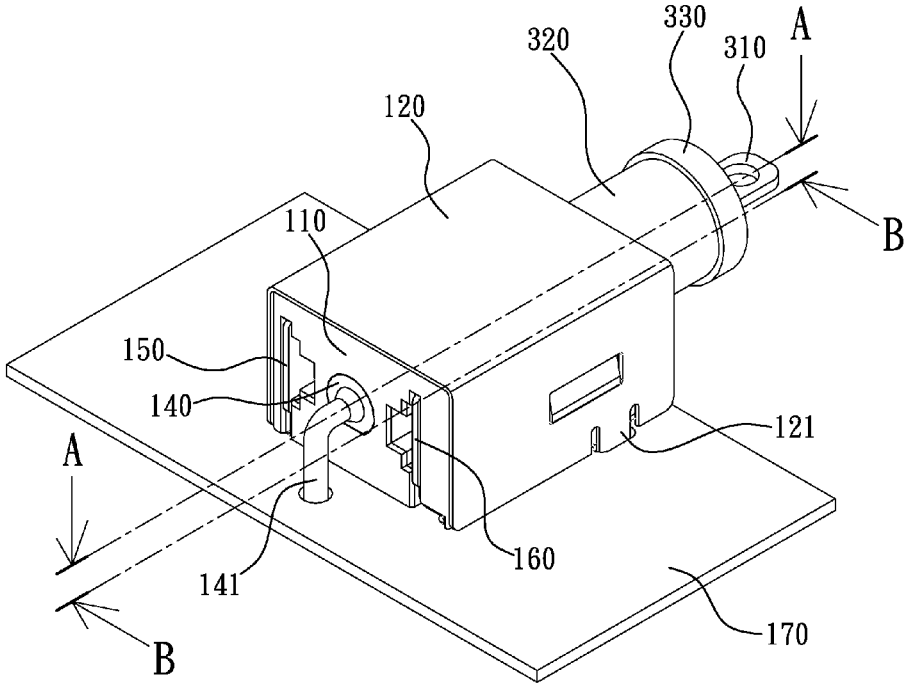
FIG. 7 is a schematic assembly view of the power connector of another preferred embodiment of the present invention.
Figure 8A:
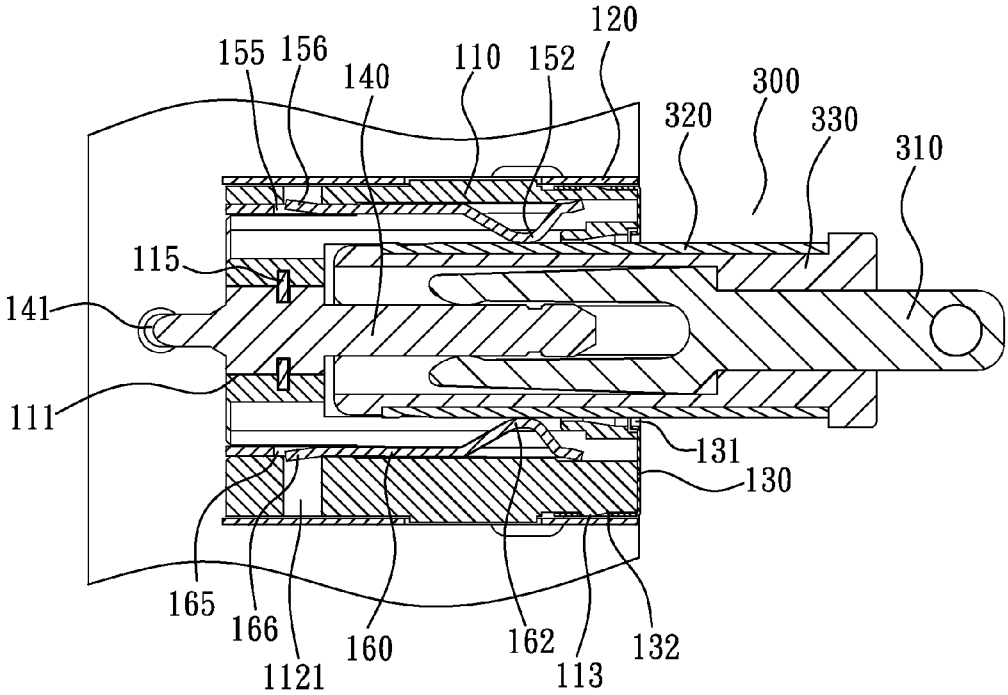
FIG. 8*a* is a schematic cross sectional view of A-A end of the power connector of another preferred embodiment of the present invention.
Figure 8B:
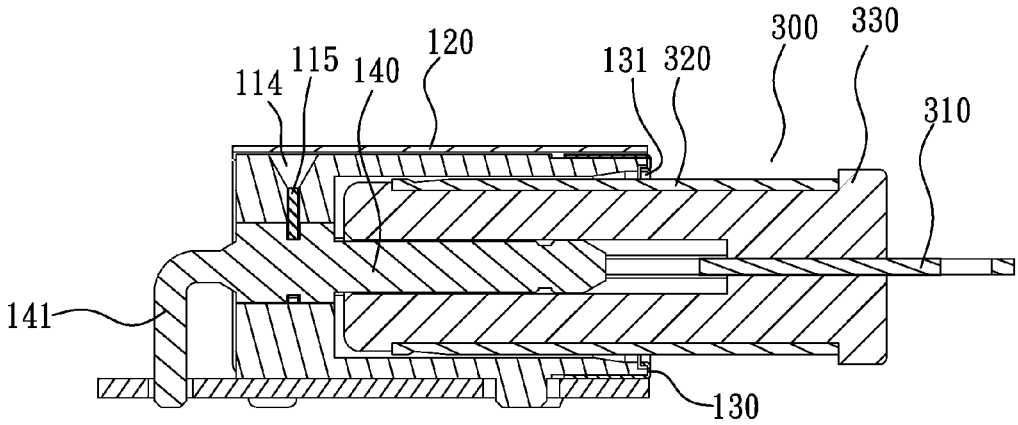
FIG. 8*b* is a schematic cross sectional view of B-B end of the power connector of another preferred embodiment of the present invention.

Referring from FIG. 6 to FIG. 8*b*, wherein FIG. 6 is a schematic exploded view of the power connector of another preferred embodiment of the present invention; FIG. 7 is a schematic assembly view of the power connector of another preferred embodiment of the present invention; FIG. 8*a* is a schematic cross sectional view of A-A end of the power connector of another preferred embodiment of the present invention; FIG. 8*b* is a schematic cross sectional view of B-B end of the power connector of another preferred embodiment of the present invention.

As shown in figures, the power connector provided by the present invention is capable of receiving a plug 300; the plug 300 includes an electric conduction terminal 310, a sleeve 320 and a terminal seat 330; wherein the electric conduction terminal 310, the sleeve 320 and the terminal seat 330 are conventional arts and are not the primary features of the present invention, therefore no further illustration is provided. The power connector provided by the present invention comprises: a body 110; a shield housing 120; a front cover 130; a positive column 140; a first grounding terminal 150; and a second grounding terminal 160.

The body 110 is made of, e.g. but not limited to, plastic material, and is installed with a through hole 111, two sides of the through hole 111 are respectively installed with a guiding slot 112, two sides of the body 110 are respectively installed with a protrusion 113. The top end of the body 110 is further provided with a fastening slot 114 disposed on top of the through hole 111.

The shield housing 120 is made of metal material, e.g. but not limited to stainless steel, and the shield housing 120 is hollow and is able to be engaged with the body 110.

The front cover 130 is made of metal material, e.g. but not limited to stainless steel, the front cover 130 is able to be engaged with the shield housing 120 and the front end thereof has an orifice 131, the sides thereof are respectively installed with a cover hole 132 for accommodating the protrusions 113 and allowing the protrusions 113 to be exposed.

One end of the positive column 140 is accommodated in the through hole 111, the other end thereof is exposed outside the body 110 and downwardly bended to form a welding portion 141 for being installed a substrate 170.

The first grounding terminal 150 is accommodated in the guiding slot 112, one end thereof has a first terminal hole 151 installed with an inward-retracted first resilient sheet 152, the other end thereof is downwardly extended with a first welding sheet 153 for being installed on the substrate 170. As shown in FIG. 8*a*, when the plug 300 is inserted in the body 110, firstly the electric conduction terminal 310 is in contact with the positive column 140, the first resilient sheet 152 is not only served to be in contact with the sleeve 320 for providing a grounding function, but also served to provide a buffering effect of applying longitudinal force on top of the sleeve 320. Moreover, the other end of the first grounding terminal 150 is further installed a third terminal hole 155 having an inward-retracted reverse stab 156.

The second grounding terminal 160 is accommodated in another guiding slot 112, and one end thereof has a second terminal hole 161 installed with an inward-retracted second resilient sheet 162, the other end thereof is outwardly extended then downwardly bended to form a second welding sheet 163, the second grounding terminal 160 is not only served to be in contact with the sleeve 320 for providing a grounding function, but also served to provide a buffering effect of applying longitudinal force below the sleeve 320. Moreover, the other end of the second grounding terminal 160 is further installed a fourth terminal hole 165 having an inward-retracted reverse stab 166.

The body 110 of the present invention is further installed with a fastening sheet 115 capable of being received in the fastening slot 114 for fastening the positive column 140. The fastening sheet 115 is in, e.g. but not limited to, reversed-U shape and is made of metal material, e.g. but not limited to stainless steel.

The guiding slots 112 installed on the two sides of the body 110 are further respectively provided with an opening slot 1121 for respectively receiving the first reserve stab 156 and the second reserve stab 166.

Moreover, two sides of the shield housing 120 of the present invention are further respectively installed with a protruding sheet 122 for being installed and welded on the substrate 170.

As shown in FIG. 7, FIG. 8*a* and FIG. 8*b*, when the power connector of the present invention is being used with the plug 300, the plug 300 is inserted in the orifice 131 of the front cover 130 and is continuously being forwardly inserted till two ends of the electric conduction terminals 310 clamp the positive column 140, such that the front end of the sleeve 320 of the plug 300 is respectively in contact with the front end of the first resilient sheet 152 and the front end of the second resilient sheet 162 so as to be respectively upwardly and downwardly pressed, meanwhile the first reverse stab 156 and the second reverse stab 166 are respectively entered the opening slots 1121 installed at the two sides of the body 110 for preventing the first grounding terminal 150 and the second grounding terminal 160 from being released from the body 110, so the connection of the power connector of the present invention and the plug 300 is completed. The power connector of the present invention, compared with conventional power connectors, has following advantages: 1. a resilient sheet is inwardly installed on a grounding terminal for providing buffering function; 2. the grounding terminal is installed with a reverse stab for being fastened on the body for preventing from being released from the body; and 3. required material for forming the terminal is reduced and the structure thereof is enhanced. Therefore the power connector of the present invention is novel compared with the conventional power connectors.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power connector, capable of receiving a plug having an electric conduction terminal, a sleeve and a terminal seat, comprising:

a body having a through hole, two sides of said through hole being respectively installed with a guiding slot, two sides of said body being respectively installed with a protrusion;

a shield housing, being hollow and engaged with said body;

a front cover engaged with said shield housing, the front end thereof having an orifice, two sides thereof being respectively installed with a cover hole for accommodating said protrusions and allow said protrusions to be exposed;

a positive column, one end thereof being received in said through hole, the other end thereof having a wire hole and being exposed outside said body;

a first grounding terminal inserted in one of said guiding slots, one end thereof having a first terminal hole installed with an inward-retracted first resilient sheet, the other end thereof being bended so as to form a first welding sheet, when the plug being inserted, the first resilient sheet being in contact with the sleeve for providing a buffering effect; and a second grounding terminal inserted in the other guiding slot, one end thereof having a second terminal hole installed with an inward-retracted second resilient sheet, when the plug being inserted, the second resilient sheet being in contact with the sleeve for providing a buffering effect, the other end thereof being outwardly extended with a second welding sheet.

2. The power connector as claimed in claim 1, wherein said body is made of insulation material, said shield housing and said front cover are made of metal material.

3. The power connector as claimed in claim 1, wherein the top end of said body is further installed with a fastening slot.

4. The power connector as claimed in claim 3, wherein said body is further installed with a fastening sheet inserted in said fastening slot for fastening said positive column.

5. The power connector as claimed in claim 1, wherein two sides of said body are respectively installed with a flange.

6. The power connector as claimed in claim 5, wherein said guiding slots installed at the two sides of said body are respectively installed with an opening slot disposed at a lateral side of said flange.

7. The power connector as claimed in claim 6, wherein the other end of said first grounding terminal is provided with a third terminal hole installed with an inward-retracted first reverse stab received in one of said opening slots.

8. The power connector as claimed in claim 6, wherein the other end of said second grounding terminal is provided with a fourth terminal hole installed with an inward-retracted second stab received in the other opening slot.

9. The power connector as claimed in claim 1, wherein said first welding sheet is further installed with a first welding hole, said second welding sheet is further installed with a second welding hole.

10. The power connector as claimed in claim 9, wherein a distal end of said shield housing is further installed with a third welding sheet aligned with said first welding hole for being welded on a substrate.

11. A power connector, capable of receiving a plug having an electric conduction terminal, a sleeve and a terminal seat, comprising:

a body having a through hole, two sides of said through hole being respectively installed with a guiding slot, two sides of said body being respectively installed with a protrusion;

a shield housing, being hollow and engaged with said body;

a front cover engaged with said shield housing, the front end thereof having an orifice, two sides thereof being respectively installed with a cover hole for accommodating said protrusions and allowing said protrusions to be exposed;

a positive column, one end thereof being received in said through hole, the other end thereof being exposed outside said body and being downwardly bended to form a welding portion;

a first grounding terminal inserted in one of said guiding slots, one end thereof having a first terminal hole installed with an inward-retracted first resilient sheet, the other end thereof being downwardly extended with a first welding sheet, when said plug being inserted, said first resilient sheet being in contact with said sleeve for providing a buffering effect; and a second grounding terminal inserted in the other guiding slot, one end thereof having a second terminal hole installed with an inward-retracted second resilient sheet, when said plug being inserted, said second resilient sheet being in contact with said sleeve for providing a buffering effect, the other end thereof being outwardly extended then downwardly bended to form a second welding sheet.

12. The power connector as claimed in claim 11, wherein said body is made of insulation material, said shield housing and said front cover are made of metal material.

13. The power connector as claimed in claim 11, wherein the top end of said body is further installed with a fastening slot.

14. The power connector as claimed in claim 13, wherein said body is further installed with a fastening sheet inserted in said fastening slot for fastening the positive column.

15. The power connector as claimed in claim 11, wherein two sides of said body are respectively installed with a flange.

16. The power connector as claimed in claim 15, wherein said guiding slots installed at the two sides of said body are respectively installed with an opening slot disposed at a lateral side of said flange.

17. The power connector as claimed in claim 16, wherein the other end of said first grounding terminal is provided with a third terminal hole installed with an inward-retracted first reverse stab received in one of said opening slots.

18. The power connector as claimed in claim 16, wherein the other end of said second grounding terminal is provided with a fourth terminal hole installed with an inward-retracted second stab received in the other opening slot.

* * * * *